US010317839B2

(12) United States Patent
Tamaki et al.

(10) Patent No.: US 10,317,839 B2
(45) Date of Patent: Jun. 11, 2019

(54) DEVELOPING DEVICE AND IMAGE FORMING APPARATUS

(71) Applicants: Shinji Tamaki, Tokyo (JP); Ichiro Kadota, Kanagawa (JP); Junichi Matsumoto, Kanagawa (JP); Tatsuya Kubo, Kanagawa (JP); Hiroaki Okamoto, Kanagawa (JP)

(72) Inventors: Shinji Tamaki, Tokyo (JP); Ichiro Kadota, Kanagawa (JP); Junichi Matsumoto, Kanagawa (JP); Tatsuya Kubo, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/989,689

(22) Filed: May 25, 2018

(65) Prior Publication Data

US 2018/0348698 A1 Dec. 6, 2018

(30) Foreign Application Priority Data

May 30, 2017 (JP) ..... 2017-106090

(51) Int. Cl.
*G03G 15/01* (2006.01)
*G03G 15/08* (2006.01)
*G03G 21/16* (2006.01)

(52) U.S. Cl.
CPC ..... *G03G 21/1676* (2013.01); *G03G 15/0121* (2013.01); *G03G 15/0898* (2013.01)

(58) Field of Classification Search
CPC ..... G03G 21/1676; G03G 15/0121; G03G 15/0898
See application file for complete search history.

(56) References Cited

U.S. PATENT DOCUMENTS 4,561,759 A * 12/1985 Knott ..... G03G 15/087 222/200
4,974,023 A * 11/1990 Aimoto ..... G03G 15/0844 399/119

(Continued)

FOREIGN PATENT DOCUMENTS

JP 61156174 A * 7/1986 ..... G03G 15/0875
JP 2007-225866 9/2007

(Continued)

*Primary Examiner* — Ryan D Walsh
(74) *Attorney, Agent, or Firm* — Harness, Dickey & Pierce, P.L.C.

(57) ABSTRACT

A developing device includes a developer bearer the surface of which moves with a developer thereon, a development housing including the developer in an inner space thereof and an opening through which the surface of the developer bearer is partially exposed in a direction of surface movement thereof to face a latent image bearer a surface of which moves with a latent image thereon, a drive assembly disposed in the development housing, configured to drive members in the development housing driven by a driven force of the drive assembly, and a collision assembly including a collision member, the collision assembly being configured to move the collision member away from the development housing and toward the development housing to collide the collision member with the development housing, utilizing the drive force of the drive assembly.

9 Claims, 11 Drawing Sheets

(56) References Cited

U.S. PATENT DOCUMENTS 5,074,342 A * 12/1991 Kraehn ..... G03G 15/0879 141/263
5,270,785 A * 12/1993 Kita ..... G03G 15/0877 222/DIG. 1
6,266,511 B1 * 7/2001 Murakami ..... G03G 21/105 222/DIG. 1
7,249,616 B2 * 7/2007 Turri ..... B65B 1/04 141/18
7,890,003 B2 * 2/2011 Ito ..... G03G 21/1842 399/261
2004/0011425 A1 * 1/2004 Wegman ..... B65B 1/08 141/311 A
2008/0031657 A1 * 2/2008 Okuda ..... G03G 15/0879 399/258
2008/0317481 A1 * 12/2008 Nagano ..... G03G 15/0875 399/27
2010/0202802 A1 * 8/2010 Takeshita ..... G03G 9/107 399/258
2012/0114403 A1 * 5/2012 Takenouchi ..... G03G 15/161 399/350
2012/0224889 A1 * 9/2012 Tajiri ..... G03G 15/0808 399/258
2015/0104218 A1 4/2015 Komatsu et al.
2015/0323884 A1 11/2015 Kikuchi et al.
2015/0346635 A1 12/2015 Nodera et al.
2016/0004184 A1 1/2016 Kikuchi et al.
2016/0033901 A1 2/2016 Matsumoto et al.
2016/0041498 A1 2/2016 Terai et al.
2016/0062274 A1 3/2016 Kadota et al.
2016/0070208 A1 3/2016 Kikuchi et al.
2016/0161885 A1 6/2016 Hosokawa et al.
2016/0170329 A1 6/2016 Kimura et al.
2016/0170356 A1 6/2016 Mabuchi et al.
2016/0195846 A1 7/2016 Koshizuka et al.
2016/0202630 A1 7/2016 Okamoto et al.
2016/0202660 A1 7/2016 Terai et al.
2016/0238966 A1 8/2016 Oshikawa et al.
2016/0363887 A1 12/2016 Nodera et al.
2017/0010564 A1 1/2017 Kikuchi et al.
2017/0102642 A1 4/2017 Matsumoto et al.
2017/0108795 A1 4/2017 Oshikawa et al.
2017/0108799 A1 4/2017 Hosokawa et al.
2017/0115597 A1 4/2017 Kawashima et al.
2017/0115604 A1 4/2017 Hosokawa et al.
2017/0115605 A1 4/2017 Yoshida et al.
2017/0227922 A1 8/2017 Takami et al.
2017/0315473 A1 11/2017 Hosokawa et al.
2017/0363987 A1 12/2017 Nodera et al.
2018/0120737 A1 5/2018 Okamoto et al.

FOREIGN PATENT DOCUMENTS

JP 2009-053274 3/2009
JP 2013-044932 3/2013

* cited by examiner

DEVELOPING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application No. 2017-106090, filed on May 30, 2017, in the Japan Patent Office, the entire disclosure of which is hereby incorporated by reference herein.

BACKGROUND

Technical Field

The present disclosure relates to a developing device and an image forming apparatus.

Description of the Related Art

Developing devices are known which include a developer bearer the surface of which moves with a developer thereon, a development housing including the developer in its inner space and an opening from which the surface of the developer bearer is partially exposed in the direction of surface movement thereof to face a latent image bearer the surface of which moves with a latent image thereon, a drive assembly to drive members disposed in the development housing, and a collision assembly to move the collision member included in the collision assembly away from the development housing and thereafter toward the development housing to collide the collision member with the development housing.

A developing device has been proposed which includes a filter to prevent a developer from being discharged out of a development housing through a depressurizing opening disposed to restrict a rise of the air pressure in the development housing and a vibrator to vibrate the filter to move the filter into and out of contact with the development housing, thereby colliding with the development housing.

However, in the developing device, a drive assembly such as the vibrator specially disposed to move the filter in the direction of detachment and attachment, which increases the cost of the device.

This cost-increase occurs not only to the configuration using the filter as the member for collision with a development housing but also to any configuration of moving a collision member by the drive force of a specially-disposed drive assembly to the direction of detachment and attachment for the development housing.

SUMMARY

According to the present invention, provided is an improved developing device which includes a developer bearer the surface of which moves with a developer thereon, a development housing including the developer in an inner space thereof and an opening through which the surface of the developer bearer is partially exposed in a direction of surface movement thereof to face a latent image bearer a surface of which moves with a latent image thereon, a drive assembly disposed in the development housing, configured to drive members in the development housing driven by a driven force of the drive assembly, and a collision assembly including a collision member, the collision assembly being configured to move the collision member away from the development housing and toward the development housing to collide the collision member with the development housing, utilizing the drive force of the drive assembly.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
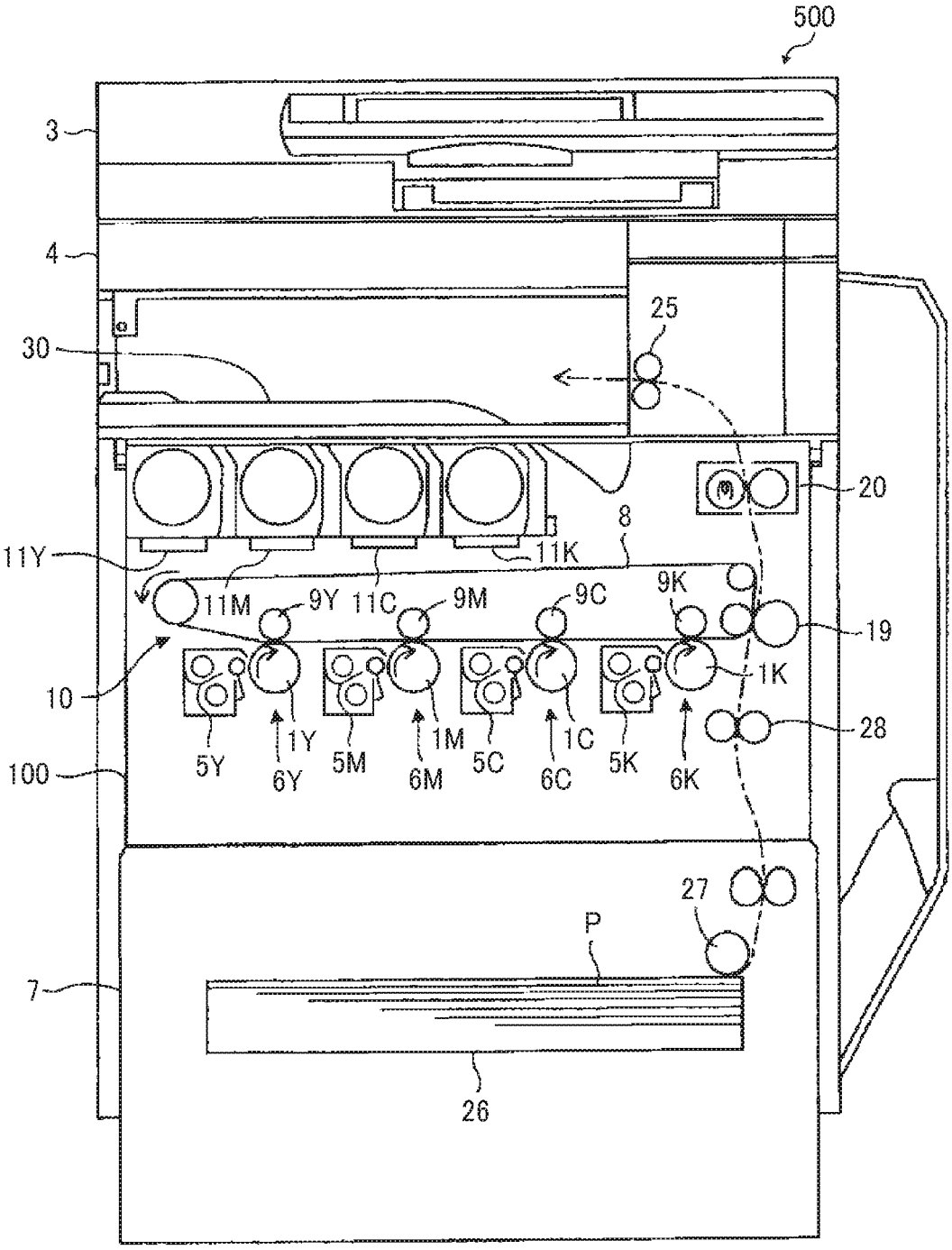
FIG. 1 is a schematic diagram illustrating an example of the photocopier according to an embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning, unless otherwise specified.

A tandem color photocopier (herein after also referred to as photocopier 500) as an image forming apparatus, to which the developing device according to an embodiment of the present disclosure is applied, is described below.

FIG. 1 is a schematic diagram illustrating the photocopier 500 according to the embodiment of the present disclosure.

The photocopier 500 includes an original scanning unit 4 and an original conveying unit 3 over a printer unit 100 and a sheet feeding unit 7 under the printer unit 100. The original conveying unit 3 conveys an original to the original scanning unit 4, which scans the original to read image information of the original. The sheet feeding unit 7 accommodates a transfer sheet P as a recording medium and includes a sheet cassette 26 where the transfer sheet P is accommodated and a sheet feeding roller 27 that sends out the transfer sheet P in the sheet cassette 26 to the printer unit 100. The dotted line in FIG. 1 represents the convey route of the transfer sheet P in the photocopier 500.

On the upper part of the printer unit 100 is disposed a sheet ejection tray 30 where the transfer sheets P on which output images are formed are stacked. The printer unit 100 includes four image forming units 6Y, 6M, 6C, and 6K to form toner images of each color (yellow, magenta, cyan, and black) and an intermediate transfer unit 10. The image forming units 6Y, 6M, 6C, and 6K respectively include photoconductors 1Y, 1M, 1C, and 1K having a drum-like form as latent image bearers on which respective color toner images are formed and developing devices 5Y, 5M, 5C, and 5K that develop latent images formed on the surface of photoconductors.

The intermediate transfer unit 10 includes an intermediate transfer belt 8 and primary transfer bias rollers 9Y, 9M, 9C, and 9K. Each color toner image formed on the surface of each of the photoconductors 1Y, 1M, 1C, and 1K is transferred and superimposed on the intermediate transfer belt 8 to form a color toner image thereon. In addition, the primary transfer bias rollers 9Y, 9M, 9C, and 9K transfer the toner image formed on the surface of each of the photoconductors 1Y, 1M, 1C, and 1K to the intermediate transfer belt 8.

The printer unit 100 includes a secondary transfer bias roller 19 that transfers the color toner image on the intermediate transfer belt 8 to the transfer sheet P. In addition, the printer unit 100 also includes a pair of registration rollers 28 that suspends conveying of the transfer sheet P fed by the sheet feeding roller 27 to control the timing of conveying the transfer sheet P to a secondary transfer nip formed by the intermediate transfer belt 8 and the secondary transfer bias roller 19 facing each other. Moreover, the printer unit 100 includes a fixing device 20 disposed above the secondary transfer nip to fix the unfixed toner image on the transfer sheet P.

In addition, below the sheet ejection tray 30 in the printer unit 100 and above the intermediate transfer unit 10 are disposed toner containers 11Y, 11M, 11C, and 11K of each color. The toner containers 11Y, 11M, 11C, and 11K of each color respectively accommodate toners of each color supplied to the developing devices 5Y, 5M, 5C, and 5K.

Figure 2:
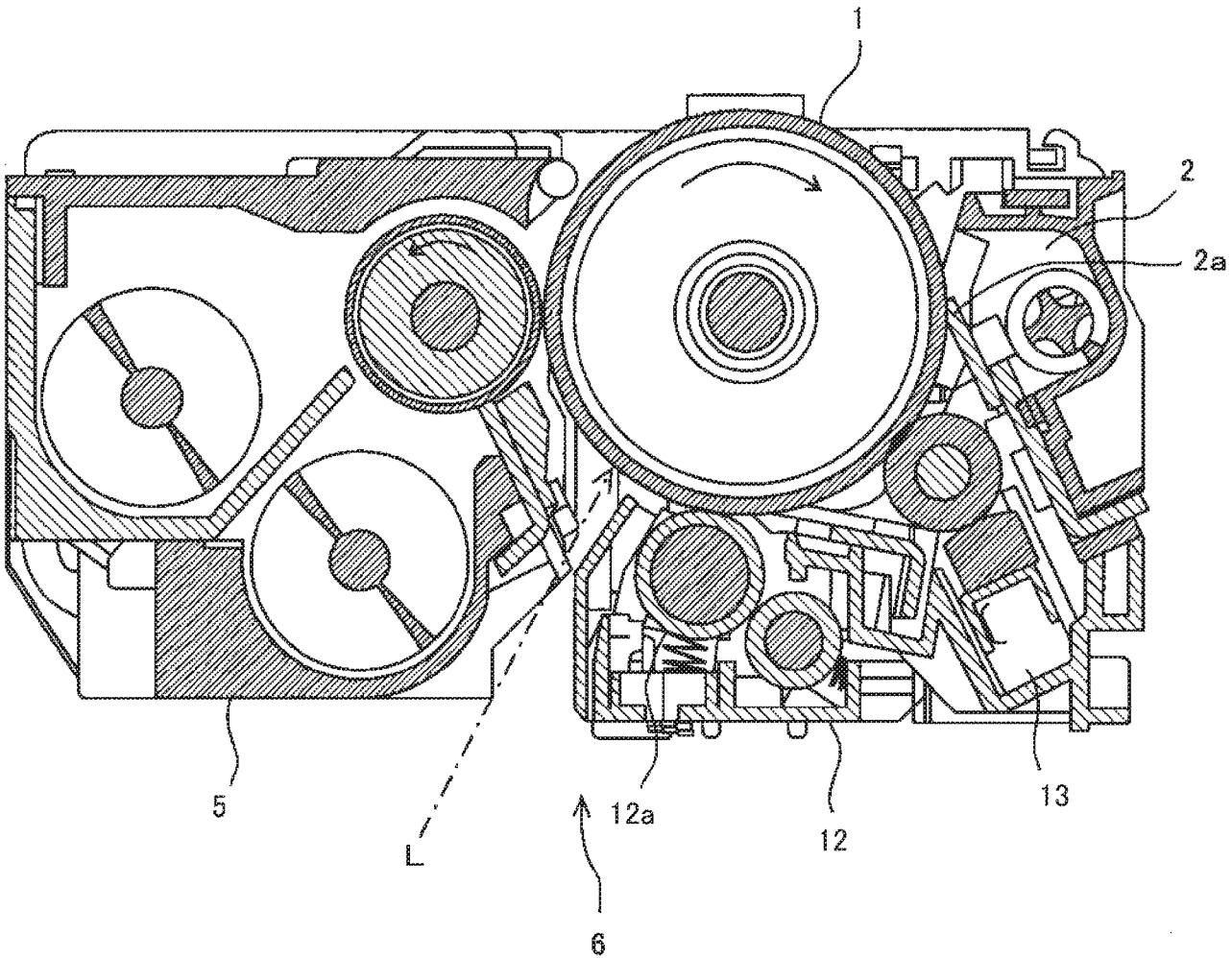
FIG. 2 is an enlarged diagram illustrating one of the four image forming units.

FIG. 2 is a diagram illustrating an enlarged view of one of the four image forming units 6Y, 6M, 6C, and 6K.

The four image forming units 6Y, 6M, 6C, and 6K are significantly the same in terms of the configuration and operation except for the color of toner for use in the image forming. Therefore, the symbols Y, M, C, and K representing their corresponding colors are timely omitted.

As illustrated in FIG. 2, the image forming unit 6 is a process cartridge integrally supporting photoconductor 1 and a developing device 5. The process cartridge is detachably attachable to the photocopier 500. For this reason, the developing device 5 can be easily replaced in the photocopier 500 including the developing device 5, which enhances maintenance property of the photocopier 500.

The image forming unit 6 includes a cleaner 2 for the photoconductor, a lubricant applicator 13, and a charger 12 around the photoconductor 1 in addition to the developing device 5. In the image forming unit 6 of the present embodiment, the cleaner 2 has a configuration of cleaning with a cleaning blade 2*a* and the charger 12 has a configuration of charging with a charging roller 12*a*.

Below is a description about the operation during typical color image forming in the photocopier 500 of the present embodiment.

Firstly, if the start button is pressed in a state in which an original is placed on a plate therefor of the original conveying unit 3, the original is conveyed from the plate by a conveying roller of the original conveying unit 3 to the contact glass of the original scanning unit 4. The original scanning unit 4 optically scans the original placed on the contact glass to obtain the image information of the original.

More specifically, the original scanning unit 4 scans the image on the original on the contact glass with light emitted from an irradiation lamp. The light reflected at the original is focused at a color sensor via a group of mirrors and lenses. After each color separation light of red, green blue (RGB) of the color image information of the original is read at the color sensor, the color image information of the original is converted into electric image signals. Furthermore, based on the color separation image signals of RGB, the signals are subject to color conversion, color calibration, spatial frequency correction, etc., at the image processing unit to obtain the color image information of yellow, magenta, cyan, and black.

The image information of each color of yellow, magenta, cyan, and black is transmitted to the writing unit. The writing unit emits a laser beam L based on the image information of each color to the corresponding photoconductors 1Y, 1M, 1C, and 1K.

On the other hand, the four photoconductors 1Y, 1M, 1C, and 1K separately rotate clockwise in FIGS. 1 and 2. The surface of the photoconductors 1Y, 1M, 1C, and 1K is uniformly charged at the facing part of the charging roller 12*a* of the charger 12 (charging process). The four light sources of the writing unit emit each laser beam L corresponding to the image signal to the charged surface of photoconductors 1Y, 1M, 1C, and 1K of each color. The surface of each photoconductor 1Y, 1M, 1C, and 1K is irradiated with the laser beams L that have passed through separate optical paths in accordance with each color component of yellow, magenta, cyan, and black (irradiation process).

The surface of the photoconductor 1Y for yellow disposed leftmost in FIG. 1 is irradiated with the laser beam L corresponding to yellow component. The laser beam L of the yellow component scans the photoconductor 1Y for yellow along the direction of rotation axis (main scanning direction) by a polygon mirror rotating at high speed. Due to this scanning of the laser beam L, a latent electrostatic image corresponding to the yellow component is formed on the surface of the photoconductor 1Y charged by the charger 12.

Similarly, the surface of the photoconductor 1M for magenta disposed second leftmost in FIG. 1 is irradiated with the laser beam L corresponding to the magenta component to form a latent electrostatic image corresponding to the magenta component thereon. The laser beam L for the cyan component is emitted to the surface of the photoconductor 1C for cyan disposed third leftmost in FIG. 1 to form a latent electrostatic image corresponding to the cyan component thereon. The laser beam L for the black component is emitted to the surface of the photoconductor 1K for black disposed fourth leftmost in FIG. 1 to form a latent electrostatic image corresponding to the black component thereon.

Thereafter, the surface of the photoconductor 1Y, 1M, 1C, and 1K on which the latent electrostatic image of each color is formed reaches the position facing the developing device 5. Thereafter, each color toner is supplied from the developing devices 5Y, 5M, 5C, and 5K accommodating the developer composed of each color toner and magnetic carrier to the surface of the photoconductor 1Y, 1M, 1C, and 1K to develop the latent image on the photoconductors 1Y, 1M, 1C, and 1K (development process).

The surfaces of the photoconductor 1Y, 1M, 1C, and 1K after they have passed the facing part (development area) reach the facing part (primary transfer area) facing the intermediate transfer belt 8. In the corresponding primary transfer areas, the primary transfer bias rollers 9Y, 9M, 9C, and 9K are disposed abutting the inner periphery of the intermediate transfer belt 8. The primary transfer nip is formed by the photoconductors 1Y, 1M, 1C, and 1K and the primary transfer rollers 9Y, 9M, 9C, and 9K facing each other with the intermediate transfer belt 8 therebetween. The toner image of each color formed on the photoconductors 1Y, 1M, 1C, and 1K is transferred and superimposed onto the intermediate transfer belt 8 at this primary transfer nip (primary transfer process).

The individual surfaces of the photoconductors 1Y, 1M, 1C, and 1K that have passed the primary transfer nip reach the position facing the cleaner 2 for the photoconductor. At the position facing the cleaner 2 for the photoconductor, untransferred toner remaining on the photoconductor is scraped off by the cleaning blade 2*a* and retrieved (cleaning process for photoconductor).

The surfaces of the photoconductors 1Y, 1M, 1C, and 1K that have passed the part facing the cleaner 2 for the photoconductor passes a quenching unit facing a quenching device to quench the remaining charges so that a series of image forming process for the photoconductor is finished and the system is ready for the next image forming.

Each color toner image on the four photoconductors 1Y, 1M, 1C, and 1K is transferred and superimposed. The surface of the intermediate transfer belt 8 bearing the color toner image moves counterclockwise in FIG. 1 and reaches the secondary transfer nip which is the position facing the secondary transfer bias roller 19. On the other hand, the transfer sheet P fed from the sheet cassette 26 accommodating the transfer sheet P by the sheet feeding roller 27 passes the conveyor guide, is guided by the pair of the registration rollers 28, hits the registration rollers 28, and temporarily stops. The transfer sheet P that has hit the pair of registration roller 28 is conveyed to the secondary transfer nip in timing with forwarding the color toner image formed on the intermediate transfer belt 8. The color toner image borne on the intermediate transfer belt 8 is transferred onto the transfer sheet P at the secondary transfer nip (secondary transfer process).

The surface of the intermediate transfer belt 8 that has passed the secondary transfer nip reaches the facing part with an intermediate transfer belt cleaner. At this facing part, the remaining toner adhering to the intermediate transfer belt 8 is retrieved by the intermediate transfer belt cleaner to finish the series of the transfer process at the intermediate transfer belt 8.

The transfer sheet P onto which the color toner image is transferred at the secondary transfer nip is guided to the fixing device 20.

In the fixing device 20, the color image is fixed onto the transfer sheet P at the fixing nip formed by a fixing roller and a pressure roller by application of heat and pressure (fixing process). The transfer sheet P that has passed the fixing device 20 is ejected as the output image outside the printer unit 100 by a pair of ejection rollers 25 and stacks on the sheet ejection tray 30

Figure 3:
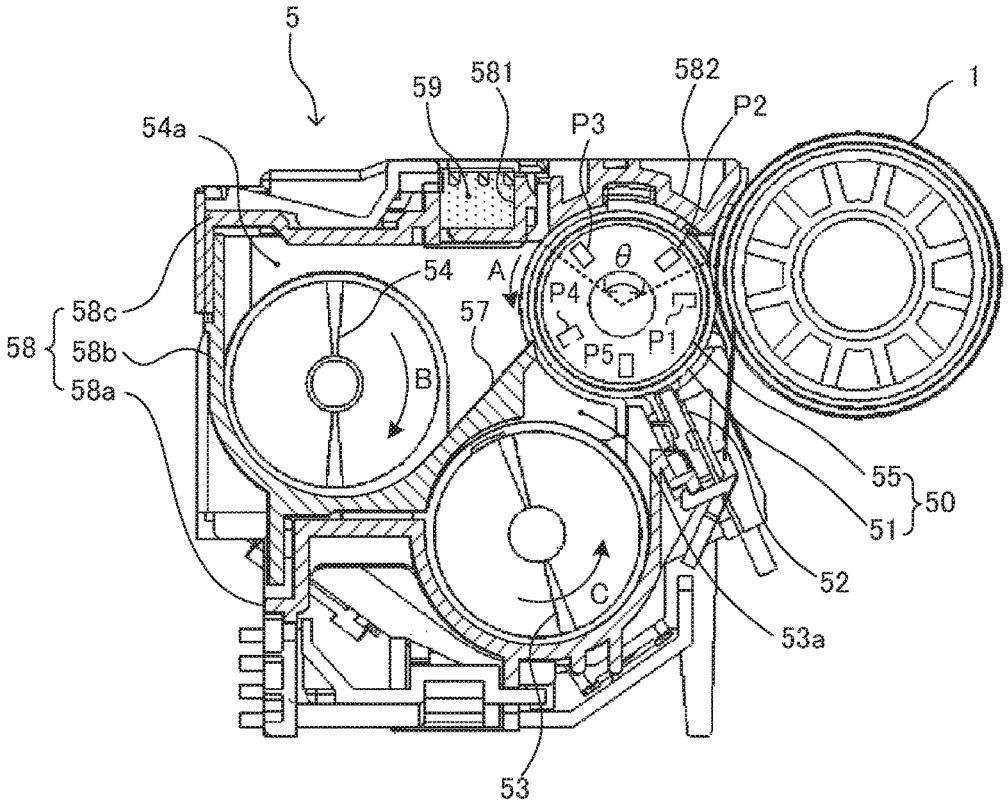
FIG. 3 is a diagram illustrating a cross section of the developing device according to an embodiment of the present disclosure.

FIG. 3 is a diagram illustrating a cross section of the developing device 5 according to the present embodiment.

The developing device 5 of the present embodiment includes a housing 58 as the development housing to accommodate the developer in the inner space of the developing device 5. The housing 58 includes a development lower housing 58*a*, a development upper housing 58*b*, and a development cover 58*c*. The developing device 5 includes a development roller 50 as a developer bearer forming the development area facing the photoconductor 1, a supply screw 53 as a supply conveying member, a retrieving screw 54 as a retrieving conveying member, a doctor blade 52 as a developer regulating member, and a separation member 57. The supply screw 53 and the retrieving screw 54 include a spiral wing part disposed onto a rotation shaft and rotate to convey the developer along the axis direction of the rotation shaft.

The housing 58 includes an opening from which the surface of the development roller 50 is partially exposed in the development area where the development roller 50 faces the photoconductor 1. The doctor blade 52 is disposed upstream of the development area where the photoconductor 1 faces the development roller 50 in the direction of the surface movement of the development roller 50 and below the development roller 50 facing the development roller 50 and regulates the amount of the developer borne on the development roller 50.

The supply screw 53 and the retrieving screw 54 are conveying members to stir and convey the developer accommodated in the inner space of the housing 58 in the longitudinal direction (direction perpendicular to the page of FIG. 3) while partially forming the circulation path. The supply screw 53 is disposed facing the development roller 50 and supplies the developer to the development roller 50 while rotating in the direction (counterclockwise) indicated by the arrow C in FIG. 3 to convey the developer in the longitudinal direction. The retrieving screw 54 receives the developer on the development roller 50 that has passed through the development area and rotates in the direction (clockwise in FIG. 3) indicated by the arrow B in FIG. 3 to convey replenished toner and the developer while mixing and stirring them.

In the inner space in the housing 58, a supply conveying path 53*a* to which the supply screw 53 is disposed and a retrieving conveying path 54*a* to which the retrieving screw 54 is disposed are spatially separated by the separation member 57. In addition, the end part of the separation member 57 in the cross section (illustrated in FIG. 3) vertically crossing the axis direction faces the surface of the development roller 50 and is disposed closely so that the separation member 57 also serves as a separation plate to promote detachment of the developer from the surface of the development roller 50. Due to this feature of the separation member 57 as the separation plate, the developer that has been borne on the development roller 50 and passed through the development area is prevented from reaching the supply conveying path 53*a* and is moved toward inside of the retrieving conveying path 54*a* without delay.

The development roller 50 includes a magnet roller 55 including multiple magnets fixed inside and a development sleeve 51 rotating in the direction (counterclockwise in FIG. 3) indicated by the arrow A around the magnet roller 55. The development sleeve 51 encloses the magnet roller 55 and has a rotatable cylindrical form made of a non-magnetic material. On the surface of the development sleeve 51, five magnetic poles of the first magnetic pole (south pole), the second magnetic pole (north pole), the third magnetic pole (south pole), the fourth magnetic pole (south pole), and the fifth magnetic pole (north pole) are formed as the multiple magnetic poles by the magnet roller 55.

In this embodiment, around the end part disposed downstream of the development roller 50 exposed from the housing 58 in the direction of surface movement of the development roller 50 (hereinafter also referred to as development downstream area), the surface movement of the development roller 50 generates suction air stream toward the inner space of the housing 58. Due to this suction air stream, scattering toner isolated from the carrier in the development downstream area can be suctioned and retrieved in the housing 58 together with air. This prevents toner scattering from the development area. In addition, in the present embodiment, to increase this suction air stream, the path space through which the suction air stream passes between a facing part 582 of the development cover 58*c* against the development roller 50 and the surface of the development roller 50 is narrowed.

Moreover, to avoid toner spraying out of the housing through a gap where the suction force into the housing 58 is weak when the inner pressure in the housing 58 rises due to this suction air stream, a depressurizing opening 581 is disposed on (formed by) the development cover 58*c* to eject the air in the housing 58 to the outside to restrict a rise of the air pressure in the housing 58. Furthermore, the depressurizing opening 581 includes a filter 59 to restrict ejection of the toner from this depressurizing opening 581. The air containing the toner in the inner space of the housing 58 passes through the filter 59, at which the toner and the air are separated so that only the air is ejected outside the housing 58 through the depressurizing opening 581.

Since the developing device 5 uses a two-component developer (including a case in which additives, etc., are added), the toner is suitably replenished into the inner space of the housing 58 through a toner replenishing opening 56 (FIG. 10) disposed on the housing 58 in accordance with the tone consumption in the developing device 5. The replenished toner is mixed and stirred together with the developer in the housing 58 while the retrieving screw 54 and the supply screw 53 convey them.

A development power source applies a development voltage to the development sleeve 51 of the development roller 50 and forms a development electric field in the development area by which the properly-charged (for example, negative polarity) toner is moved toward the latent electrostatic image part on the surface of the photoconductor 1. Due to this development electric field, the toner in the developer on the surface of the development roller 50 is attached to the latent electrostatic image on the surface of the photoconductor 1, thereby rendering the latent electrostatic image visible as a toner image.

The developer in the housing 58 is supplied to the surface of the outer perimeter of the development roller 50 due to the action of the magnetic field generated by the fifth magnetic pole P5 of the magnet roller 55 while being conveyed in the longitudinal direction by the supply screw 53 disposed in parallel with and in the vicinity of the surface of the development roller 50. The developer relayed to the surface of the development roller 50 is regulated by the doctor blade 52 and reaches the development area in accordance with the rotation counterclockwise of the development sleeve 51 as illustrated in the direction indicated by the arrow A in FIG. 3.

By the development electric field formed in the development area upon application of the development voltage to the development sleeve 51 by the development power source, the latent electrostatic image on the photoconductor 1 is developed with the toner.

The developer on the surface of the development roller 50 that has passed through the development area is returned to the inner space of the housing 58 in accordance with the rotation of the development sleeve 51 and detached from the surface of the development roller 50 as a result of the action of the repulsion magnetic field of the third magnetic pole P3 and the fourth magnetic pole P4 having the same polarity. The developer detached from the surface of the development roller 50 drops on the upper surface of the separation member 57 and slides down to the retrieving screw 54.

The doctor blade 52 has a gap from the surface of the development sleeve 51 facing the doctor blade 52 to adjust the developer borne on the development sleeve 51 to have a predetermined thickness. However, depending on foreign objects entered into the housing, the environment condition in which the developing device is installed, toner aggregation appearing in the housing 58 is stopped by the doctor blade 52, which may clog the gap. If the gap is clogged by such foreign objects and toner aggregation, the developer cannot pass through the portion where the gap is clogged so that the latent image corresponding to the portion is not developed, resulting in occurrence of images with white streaks.

Therefore, the development sleeve 51 is reversely rotated after development in the present embodiment.

Figure 4:
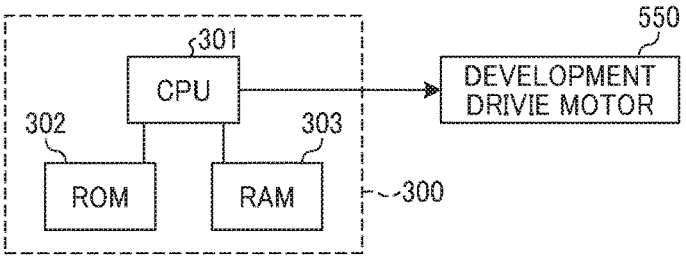
FIG. 4 is a block diagram illustrating an example of the configuration of the control system to control proper and reverse rotation of a developing sleeve.

FIG. 4 is a block diagram illustrating an example of the configuration of the control system to control proper and reverse rotation of the development sleeve 51. A control unit 300 as the control device is disposed corresponding to each of the four developing devices 5. However, the basic configuration thereof is the same. Therefore, the color separation symbols Y, M, C, and K are omitted in the description. As illustrated in FIG. 4, the control unit 300 includes a central processing unit (CPU 301), a read only memory (ROM 302), a random access memory (RAM 303), etc. In the present embodiment, the control unit 300 of each of the developing devices 5 is partially used in common in the multiple developing devices 5, for example, the CPU 301, the ROM 302, and the RAM 303.

In FIG. 4, the control unit 300 includes the the CPU 301, the ROM 302, and the RAM 303.

The control unit 300 controls drive of the development drive motor 550 as the drive source of the rotation of the development sleeve 51 and rotationally drives the development sleeve 51 counterclockwise in FIG. 3 as the normal rotation of the development sleeve 51 constituting the development roller 50 during the drive. Conversely, for the reverse control, the development sleeve is rotated clockwise in FIG. 3.

Figure 5:
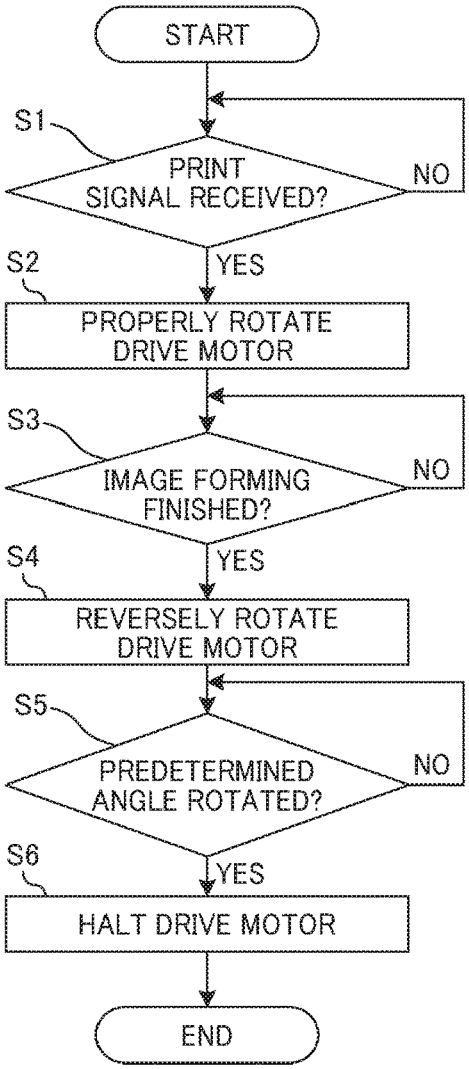
FIG. 5 is a flow chart illustrating control of a development drive motor.

FIG. 5 is a control flow chart illustrating the control of the development drive motor 550.

Upon receipt of the print signal (Yes to S1), the control unit 300 properly rotates the development drive motor 550 (S2). In accordance with the proper rotation of the development drive motor 550, the development sleeve 51 properly rotates (counterclockwise in FIG. 3) to convey the developer on the surface of the development sleeve 51 to the development area, thereby developing the latent image on the photoconductor 1.

When the image forming is complete (Yes to S3), the control unit 300 rotates the development drive motor 550 (S4) in the reverse direction against the direction during the image forming to reversely rotate the development sleeve 51 (clockwise in FIG. 3). Due to this reverse rotation of the development sleeve 51, foreign objects and toner aggregation clogging the gap between the doctor blade 52 and the development sleeve 51 are removed and drop onto the supply conveyor path 53*a*.

After the development sleeve 51 is reversely rotated at an angle (Yes to S5), the development drive motor 550 halts (S6). In the present embodiment, the development sleeve 51 is reversely rotated about 20 to about 30 degrees. Due to this reverse rotation of the development sleeve 51 about 20 to 30 degrees, foreign objects and toner aggregation clogging the gap between the doctor blade 52 and the development sleeve 51 are caused to drop onto the supply conveyor path 53*a*.

The filter 59 disposed at the depressurizing opening 581 clogs as a result of usage over time, so that the amount of air in the housing 58 ejected through the depressurizing 581 decreases. As a consequence, the amount of air entering into the housing 58 due to the suction air flow surpasses the amount of air ejected through the depressurizing opening 581, so that the inner pressure in the housing 58 increases, which may cause spraying out of the toner.

In addition, due to the usage over time, the toner adheres to the inner wall of the housing 58 and grows to form agglomeration of the toner. The agglomeration may be peeled off from the inner wall of the housing 58 in time and clog the gap between the development sleeve 51 and the doctor blade 52, which may cause production of defective images, as described above.

In addition, the scattering toner isolated from carrier and retrieved at the development downstream area together with the suction air flow tends to adhere to the facing part 582 of the development cover 58*c*, facing the development roller 50. Therefore, the scattering toner easily accumulates at this facing part 582. In due course, the toner accumulating at the facing part 582 grows to form a block, which may be peeled off from the facing part 582, spill outside the housing 58, and contaminate the image forming apparatus.

To deal with this issue, in the present embodiment, a beating device 40 is disposed to beat the housing 58. The beating device 40 beats the housing 58 to provide an impact shock to it. This impact shock vibrates the filter 59 held by the housing 58 and shakes off the toner clogged in the filter 59, thereby restricting clogging in the filter 59 over time. In addition, due to the impact shock to the housing 58 provided by beating the housing 58 by the beating device 40, the toner adhering to the inner wall of the housing 58 drops, thereby preventing agglomeration of the toner and accumulation of the toner at the facing part 582.

Figure 6:
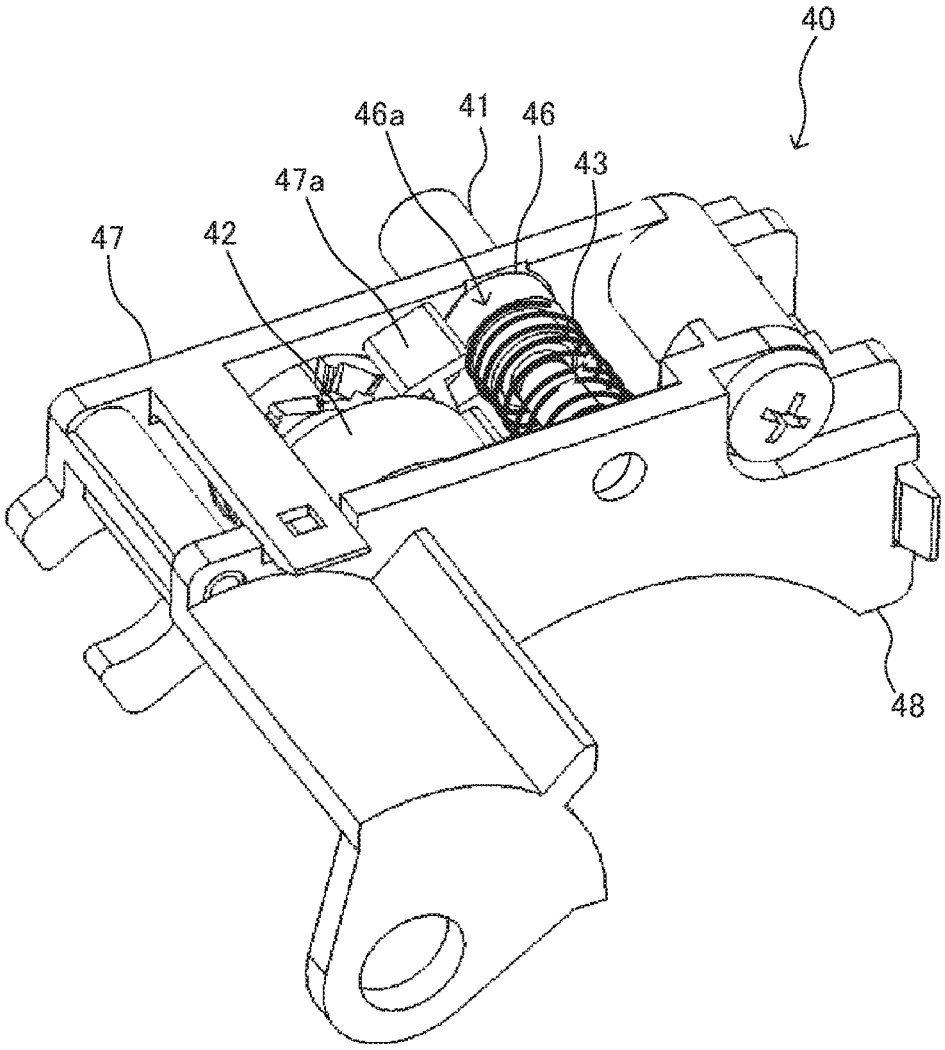
FIG. 6 is diagram illustrating a perspective view of a beating device.
Figure 7:
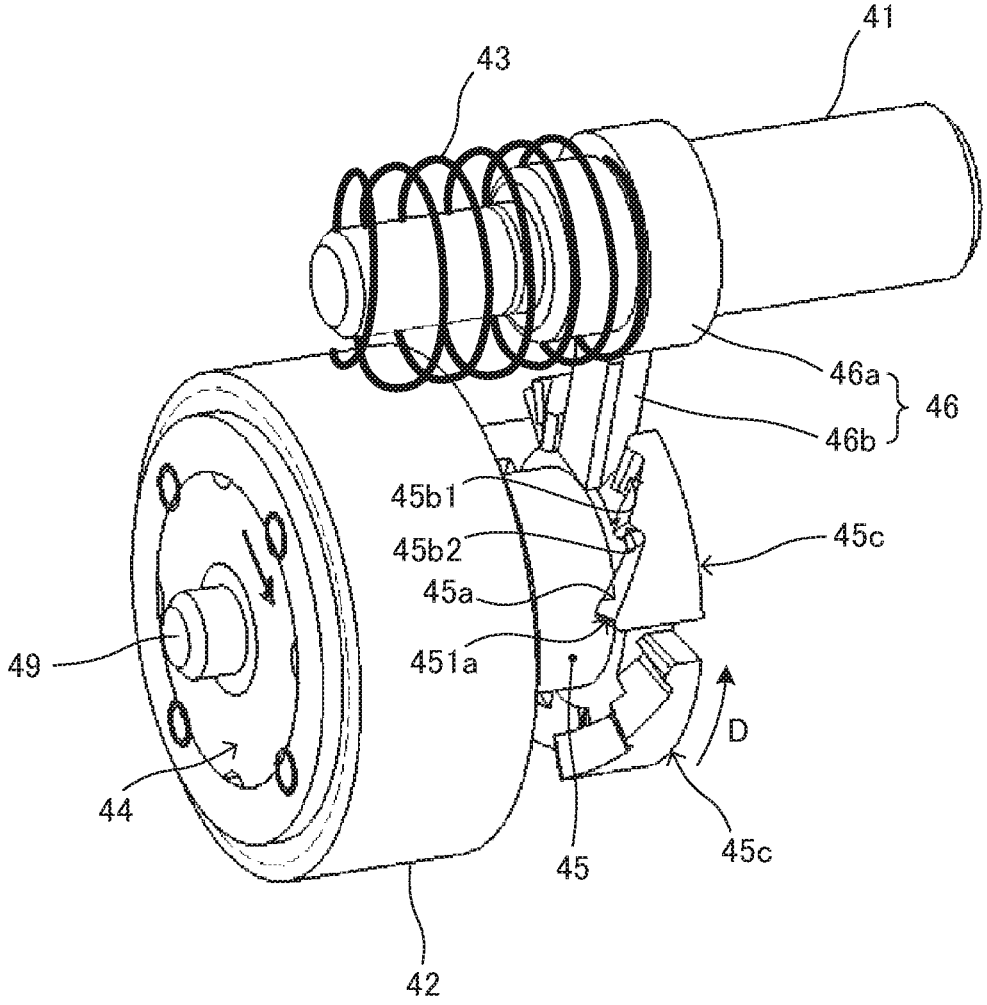
FIG. 7 is a diagram illustrating a perspective view of members constituting a beating member.
Figure 8:
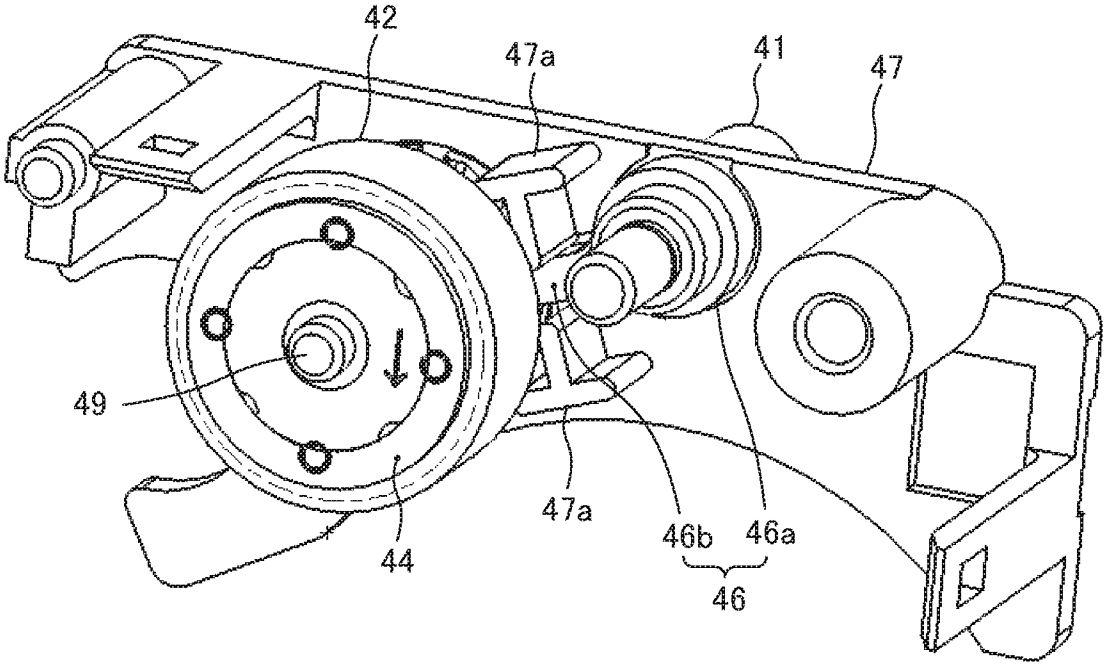
FIG. 8 is a diagram illustrating a perspective view of the beating device from which a second supporting member and a compression spring are removed.
Figure 9:
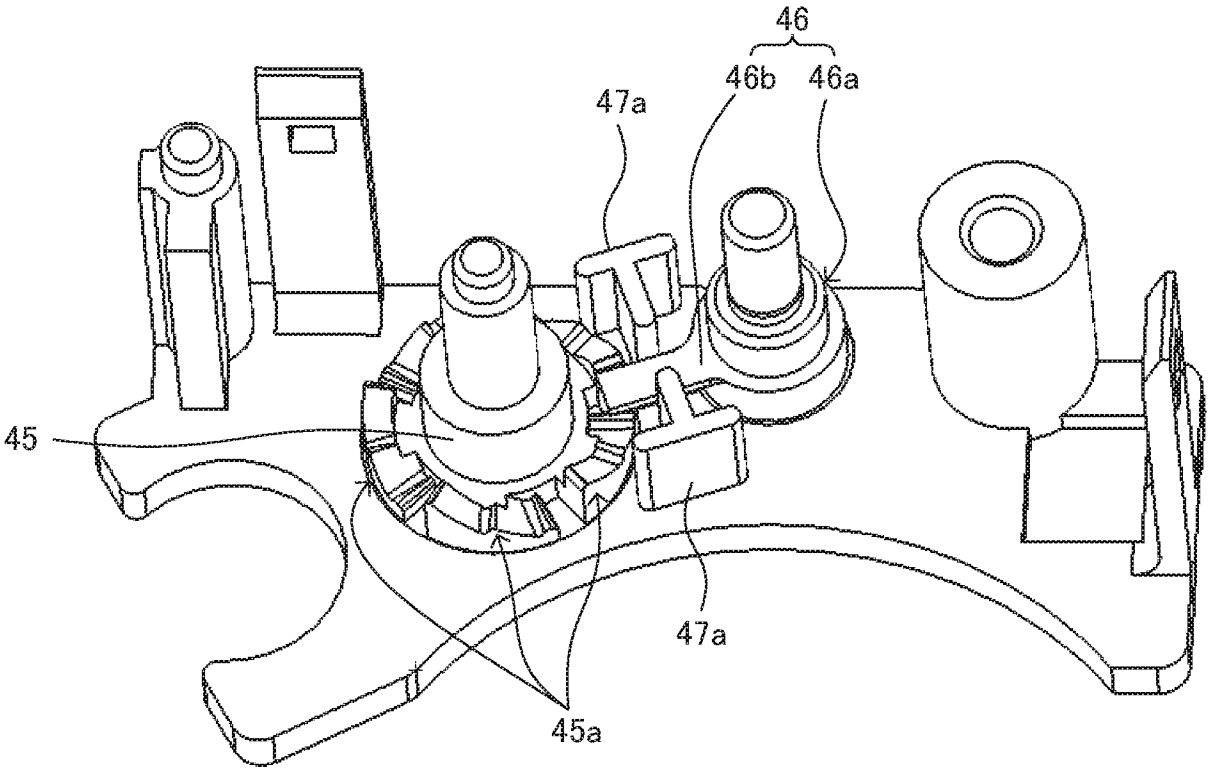
FIG. 9 is a diagram illustrating a perspective view of the beating device illustrated in FIG. 8 from which a one-way clutch is further removed.

FIG. 6 is a diagram illustrating a perspective view of the beating device 40. FIG. 7 is a diagram illustrating a perspective view of the members constituting the beating device 40. In addition, FIG. 8 is a diagram illustrating a perspective view of the beating device 40 from which a second support member 48 and a compression spring 43 are removed. FIG. 9 is a diagram illustrating a perspective view of the beating device 40 illustrated in FIG. 8 from which a one-way clutch 44 is further removed.

The beating device 40 includes a beating member 41 as a collision member to collide with the housing 58 and the compression spring 43 as a biasing member to bias the beating member 41 to the housing 58.

In addition, the beating device 40 includes a beating gear 42 to which the drive force of the development drive motor 500 is transmitted, the one-way clutch 44 to transmit the drive force during the reverse rotation, and a cam 45 to move the beating member 41 away from the housing 58 against the biasing force of the compression spring 43.

The beating gear 42 is fixed onto the one-way clutch 44. The one-way clutch 44 is attached to a cam shaft 49 onto which the cam 45 is fixed and shuts off the transmission of the drive force to the cam shaft 49 during the development (proper rotation of the development sleeve 51). Also, the one-way clutch 44 is linked to the cam shaft 49 during the reverse rotation to transmit the drive force to rotate the cam 45.

The beating member 41 is made of metal. This metal constitution of the beating member 41 is rigid in comparison with the beating member 41 made of plastic. This high rigidity of the beating member 41 makes it possible to prevent elastic deformation of the beating member 41, which leads to absorption of the impact shock of the beating member 41 against the housing 58, so that the impact shock to the housing 58 becomes great.

A cam follower 46 is put around the beating member 41. The cam follower 46 includes a putting-around part 46*a* having a ring-like form put around the beating member 41 and an arm 46*b* extending along the normal line from the putting-around part 46*a* with the front end abutting the cam 45.

As illustrated in FIG. 6, the beating member 41 pierces a first support member 47. The compression spring 43 is disposed compressed between the putting around part 46*a* of the cam follower 46 and the second support member 48. In addition, the putting-around part 46*a* of the cam follower 46 abuts the first support member 47 and serves to prevent the beating member 41 from dropping out of the first support member 47 due to the biasing force of the compression spring 43.

As illustrated in FIGS. 8 and 9, a pair of whirl stops 47*a* to stop the cam follower 46 from revolving is disposed onto the first support member 47. The arm 46*b* of the cam follower 46 extends between the pair of whirl stops 47*a* to the position where the front end abuts against a slant surface 45*a* of the cam 45.

The cam 45 is fixed onto the cam shaft 49 and includes multiple slant parts 45*c* around the circumference direction. The slant part 45*c* includes the slant surface 45*a* slanting against the plane orthogonal to the cam shaft 49. Specifically, the slant surface 45*a* gradually slants away from the first support member 47 as the slant surface 45*a* goes upstream of the cam 45 in the rotation drive direction (direction indicated by the arrow D in FIG. 7) by the development drive motor 550. The slant surface 45*a* abuts the front end of the arm 46*b* and raises the arm 46*b* by the rotation of the cam 45 against the biasing force of the compression spring 43 to move the beating member 41 away from the housing 58. This slant surface 45*a* includes two stoppers 45*b*1 and 45*b*2 spaced a predetermined distance therebetween to hold the front end of the arm 46*b*. In the present embodiment, the slant surface 45*a* has steps to form the stoppers 45*b*1 and 45*b*2.

Figure 10:
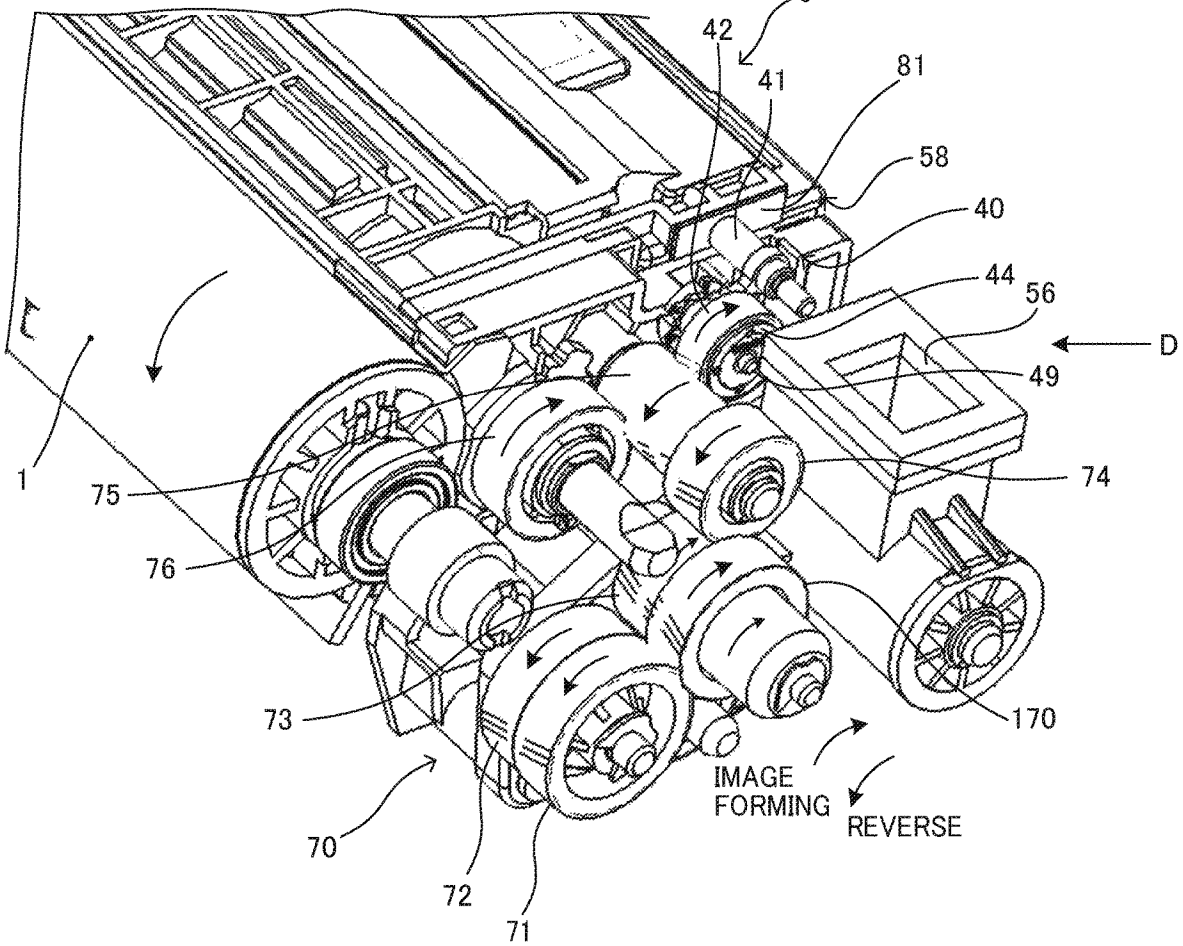
FIG. 10 is a diagram illustrating a perspective view of a drive transmission unit to transmit the drive force of the development drive motor to the development sleeve, the beating device, etc.

FIG. 10 is a diagram illustrating a perspective view of a drive transmission unit 70 to transmit the drive force of the development drive motor 550 to the development sleeve 51, the beating device 40, etc.

The drive transmission unit 70 includes an input gear 71 engaged with a drive output gear 170 disposed on the side of the printer unit 100 to which the drive force of the development drive motor 550. The input gear 71 is fixed on one end of the shaft of the supply screw 53 and the drive force is transmitted from the drive output gear 170 to the input gear 71 to rotate the supply screw 53.

In addition, a step gear 72 rotating with the input gear 71 is disposed on the shaft of the supply screw 53 and an idler gear 73 is engaged with the step gear 72. The idler gear 73 is engaged with a bifurcating input gear 74. A bifurcating output gear 75 integrally rotating with the bifurcating input gear 74 is engaged with a development gear 76 fixed onto the development sleeve 51 and the beating gear 42 of the beating device 40. Due to this, the drive force of the development drive motor 550 as the drive device to drive the development sleeve 51 is transmitted to the beating device 40 to drive the beating device 40. Therefore, in comparison with a configuration including a drive device to drive the beating device 40 separating from the drive device to drive the development sleeve 51, the device can be inexpensively manufactured.

At the end on the reverse side positioned opposite to the side on which the input gear 71 of the shaft of the supply screw 53 is disposed, a retrieving output gear is disposed onto the retrieving screw 54 to transmit the drive force of the development drive motor 550. The drive force is transmitted from the retrieving output gear to the retrieving screw 54 via one or more gears to rotate the retrieving screw 54.

Figure 11:
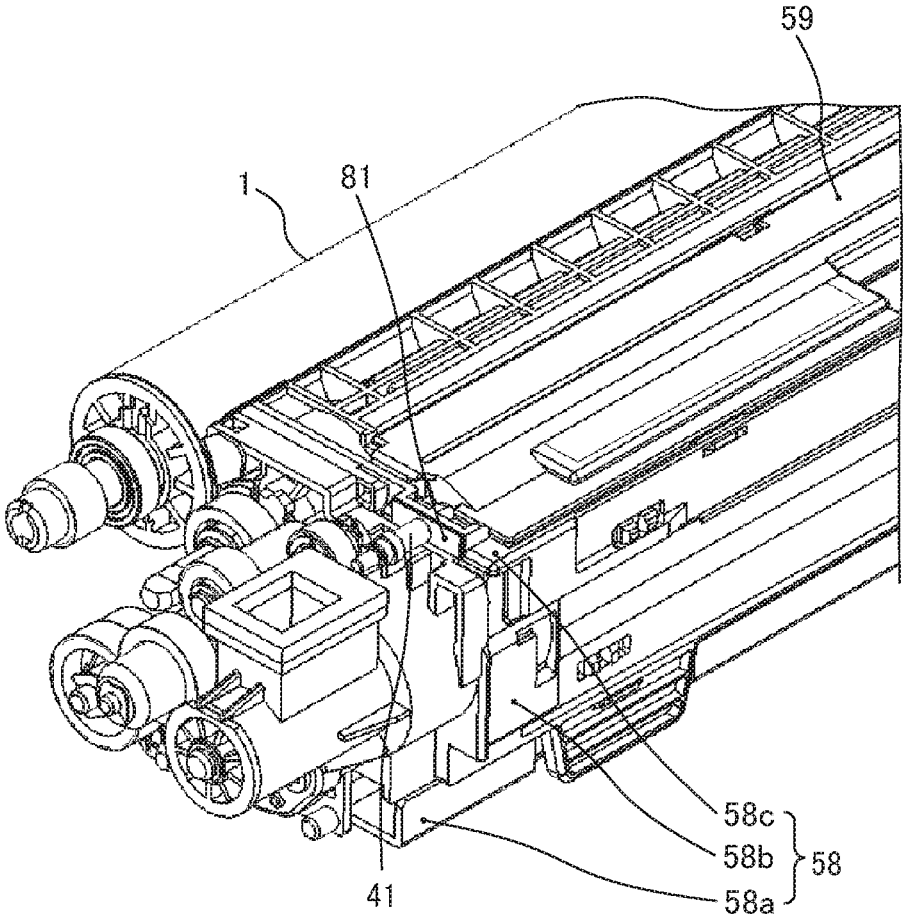
FIG. 11 is a diagram illustrating a perspective view from the direction of an arrow D of FIG. 10.
Figure 12:
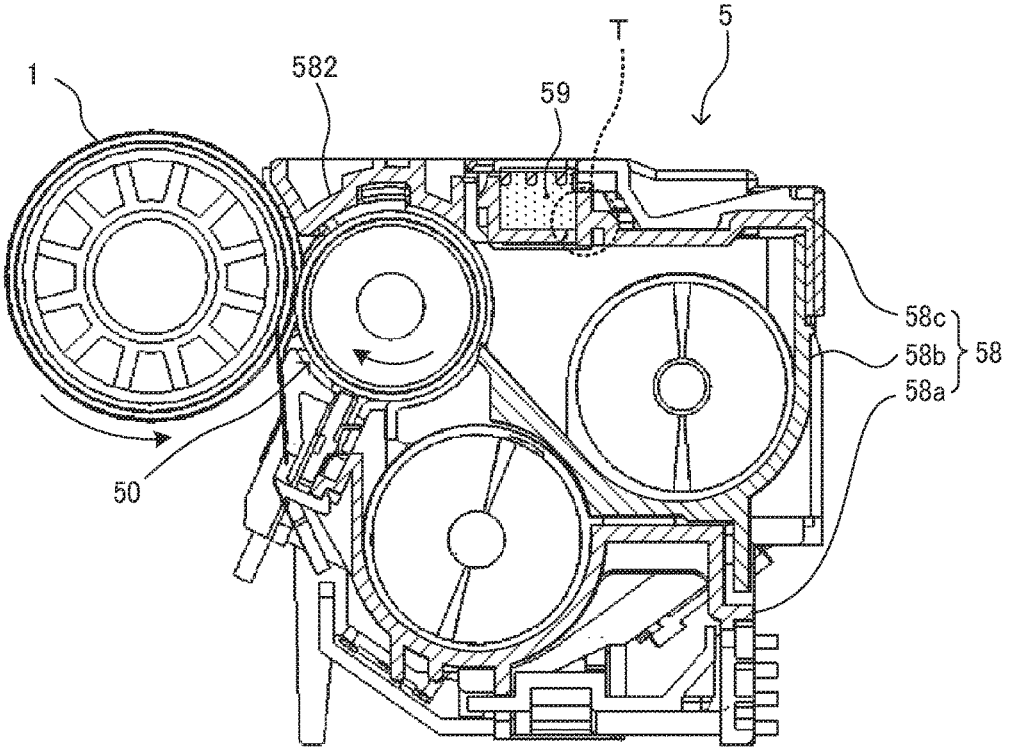
FIG. 12 is a diagram illustrating a beating position of the beating member.

FIG. 11 is a diagram illustrating a perspective view from the direction indicated by the arrow D in FIG. 10. FIG. 12 is a diagram illustrating the beating position of the beating member 41.

The beating member 41 is disposed in such a manner that the beating member 41 collides at a position close to the part (indicated by the dotted line T in FIG. 12) where the filter 59 of the development cover 58*c* is held. Due to this, the shock impact at the time of the collision of the beating member 41 is transmitted to the filter 59 with less attenuation to appropriately drop the toner from the filter 59. In addition, beating the development cover 58*c* also directly conveys the impact shock to the facing part 582 disposed on the development cover 58*c* as well. Due to this, the toner adhering to the facing part 582 can be beaten off to restrict accumulation of the toner at the facing part 582. Therefore, it is possible to prevent the device from being contaminated by the toner block appearing as a result of accumulation at the facing part 582 and falling off outside the housing 58.

In addition, the impact shock is transmitted from the development cover 58*c* to the development upper housing 58*b* and the development lower housing 58*a*, thereby beating off the toner adhering to the inner wall of the development lower housing 58*a* and the development upper housing 58*b*. Due to this, it is possible to restrict occurrence of toner aggregation in the housing 58.

In addition, as illustrated in FIG. 11, a shock absorber 81 is disposed on the part where the beating member 41 of the development cover 58*c* collides. The shock absorber 81 relieves the impact noise occurring at the time of collision of the beating member 41.

In the present embodiment, at the reverse rotation after image forming, the drive force of the development drive motor 550 is transmitted to the cam 45 to drive the beating device 40. Due to this, the beating member 41 can provide a shock impact to the housing 58 during non-image forming so that this shock impact has no adverse impact on produced images.

It is also possible to shut off the drive force to the cam 45 during image forming by using an electromagnetic clutch and connect the electromagnetic clutch during non-image forming to transmit the drive force to the cam 45. However, in general, electromagnetic clutches are more expensive and larger than one-way clutches. Moreover, electromagnetic clutches consume much power. Therefore, the present embodiment takes a configuration of using the one-way clutch 44 to transmit the drive force of the development drive motor 550 to the cam 45 during the reverse rotation, thereby avoiding increasing the size and cost of a device.

In the present embodiment, as described above, the reverse rotation is complete when the development sleeve 51 is reversely rotated about 20 to 30 degrees. Therefore, the arm 46*b* of the cam follower 46 cannot climb over the slant surface 45*a* of the cam 45 in the reverse rotation once. The arm 46*b* presses the slant surface 45*a* by the biasing force of the compression spring 43. If the arm 46*b* stops in the middle of the slant surface 45*a*, the cam 45 receives a force to rotate in the direction reverse to the proper rotation direction (indicated by the arrow D in FIG. 7).

If the development drive motor 550 properly rotates during the image forming, the force to stop the force to reversely rotate the cam 45 is lost. Therefore, without the stoppers 45*b*1 and 45*b*2 to the slant surface 45*a*, the cam 45 reversely rotates due to the biasing force of the compression spring 43 to follow the beating gear 42 and the front end of the arm 46*b* climbs down the slant surface 45*a*. As a result, the front end of the arm 46*b* of the cam follower 46 never climb over an apex 451*a* (FIG. 7) of the slant surface 45*a* so that the beating member 41 never beats the housing 58.

To solve this issue, it is possible to increase the amount of the reverse rotation. However, it causes the following problem if the amount is excessive. That is, due to the reverse rotation of the development sleeve 51, the developer on the separation member 57 detached from the surface of the development sleeve 51 partially adheres to the development sleeve 51 again and is conveyed to the development area. The developer that adheres to the development sleeve 51 again is conveyed to the development area with no regulation by the doctor blade 52. Therefore, the thickness of the developer is thicker than that of the developer after passing the doctor blade 52. When this developer that has adhered to the development sleeve 51 again is conveyed to the development area having a narrow gap between the photoconductor 1 and the development sleeve 51, the developer is partially regulated by the photoconductor 1. As a result, the developer regulated by the photoconductor 1 falls off and contaminates the image forming apparatus. Therefore, to prevent this problem, as illustrated in FIG. 3, the rotation angle of the development sleeve 51 during the reverse rotation is required to be not greater than an angle θ, which is from the end on the downstream of the facing part 582 in the direction of the surface moving of the development sleeve 51 during the proper rotation of the development sleeve 51 to the end of the development area on the downstream of the surface moving. As a result, the reverse rotation cannot continue to a degree that the arm 46*b* climbs over the apex 451*a* of the slant surface 45*a* during the reverse rotation.

In addition, to beat off the toner on the filter 59 or adhering to the inner surface of the housing 58, an impact of about 1,000 G is required. Therefore, the beating member 41 is moved away from the housing 58 in some degree to sufficiently accelerate the beating member before the collision with the housing 58. Therefore, the length of the slant surface 45*a* along the rotation direction is shortened for the arm 46*b* to climb over the apex 451*a* of the slant surface 45*a* with a less reverse rotation. However, the beating member 41 cannot be moved away from the housing 58 to a degree that the shock impact is about 1,000 G.

In addition, the slant angle of the slant surface 45*a* can be enlarged to move the beating member 41 away from the housing 58 to a degree that the shock impact is about 1,000 G even if the length of the slant surface 45*a* is short along the rotation direction. However, the torque of the cam 45 increases as the slant angle of the slant surface 45*a* increases. Therefore, generally, to rotate the cam 45, an expensive and high power motor is required for the development drive motor 550, which may increase the size and cost of the machine. In addition, the load to the gears constituting the drive transmission unit 70 increases, which accelerates abrasion of the gears, thereby shortening the working life of the gears.

Therefore, in the present embodiment, as described above, the stoppers 45*b*1 and 45*b*2 are disposed on the slant surface 45*a*.

If the reverse rotation starts from the state illustrated in FIG. 7 after image forming and the cam 45 rotates in the direction indicated by the arrow D illustrated in FIG. 7, the arm 46*b* of the cam follower 46 climbs up the slant surface 45*a*. Due to this, the beating member 41 moves in the direction away from the housing 58 against the biasing force of the compressions spring 43. Thereafter, when the arm 46*b* climbs over the first stopper 45*b*1 disposed downstream in the rotation direction of the cam 45, the reverse rotation is finished. At this point, the biasing force of the compression spring 43 is applied to the slant surface 45*a* of the cam 45 via the arm 46*b* so that a force is applied to the cam 45 in the direction reverse to the direction indicated by the arrow D illustrated in FIG. 7. As a result, the first stopper 45*b*1 positioned downstream of the arm 46*b* in the direction indicated by the arrow D illustrated in FIG. 7 abuts the arm 46*b*. Since the first stopper 45*b*1 abuts the arm 46*b*, a force to rotate the cam follower 46 with the beating member 41 as the point of support occurs to the arm 46*b*. However, the arm 46*b* abuts the whirl stop 47*a* illustrated in FIG. 9 to prevent the rotation of the cam follower 46. Due to this, the reverse rotation of the cam 45 against the direction indicated by the arrow D illustrated in FIG. 7 is prevented. Therefore, the arm 46*b* stays between the first stopper 45*b*1 and the second stopper 45*b*2 without climbing down the slant surface 45*a*.

In the following reverse rotation, if the cam 45 rotates in the direction indicated by the arrow D illustrated in FIG. 7 again, the arm 46*b* of the cam follower 46 further climbs up the slant surface 45*a* and moves into the direction in which the beating member 41 further moves away from the housing 58 against the biasing force of the compression spring 43. When the arm 46*b* climbs over the second stopper 45*b*2, the reverse rotation is finished. At this point, again the biasing force of the compression spring 43 is applied to the slant surface 45*a* of the cam 45 via the arm 46*b* so that a force is applied to the cam 45 in the direction reverse to the direction indicated by the arrow D illustrated in FIG. 7. However, since the second stopper 45*b*2 abuts the arm 46*b*2, the rotation reverse to the direction indicated by the arrow D illustrated in FIG. 7 is stopped.

In the further following reverse rotation, if the cam 45 rotates in the direction indicated by the arrow D illustrated in FIG. 7 again, the arm 46*b* of the cam follower 46 further climbs up the slant surface 45*a* and climbs over the apex 451*a* of the slant surface 45*a*. As a result, the arm 46*b* does not abut the slant surface 45*a* any more, and the beating member 41 furiously moves toward the housing 58 by the biasing force of the compression spring 43 and collides the housing 58.

In the present embodiment, as described above, since the stopper 45*b*1 and the 45*b*2 are disposed on the slant surface 45*a*, the arm 46*b* finally climbs up the apex 451*a* of the slant surface 45*a* in multiple reverse rotation operations even when the drive amount during the reverse rotation is small. Therefore, it is possible to move the beating member 41 away from the housing 58 in such a manner that a shock impact of about 1,000 G to the housing 58 can be applied. In addition, the arm 46*b* can climb up the apex 451*a* of the slant surface 45*a* in multiple reverse rotations, so that the slant angle of the slant surface 45*a* can be reduced in comparison with the case in which the arm 46*b* climbs up the apex 451*a* of the slant surface 45*a* on a single reverse rotation. Therefore, it is possible to reduce an increase of the torque to rotate the cam 45 in comparison with the case in which the arm 46*b* climbs up the apex 451*a* of the slant surface 45*a* on a single reverse rotation. Therefore, in comparison with the case in which the arm 46*b* climbs up the apex 451*a* of the slant surface 45*a* on a single reverse rotation, it is possible to use a motor with lower power as the development drive motor 550, thereby reducing the size and the cost of a device.

The stopper can be disposed in such a manner that the arm 46*b* can climb over the stopper in accordance with the rotation angle of the cam 45 during reverse rotation. The number of stoppers and the positions thereof can be determined to suit to the configuration of the device.

The above-described is just an example and other aspects of the present disclosure are, for example, as follows.

Aspect 1

1. The developing device 5 includes a developer bearer such as the development roller 50, the surface of which moves with a developer thereon, a development housing such as the housing 58 including the developer in an inner space thereof and an opening through which the surface of the developer bearer is partially exposed in a direction of surface movement thereof to face a latent image bearer such as the photoconductor 1 the surface of which moves with a latent image thereon, a drive assembly such as the development drive motor 550 disposed in the development housing, configured to drive members in the development housing driven by a driven force of the drive assembly, and a collision assembly such as the beating device 40 including a collision member such as the beating member 41, the collision assembly being configured to move the collision member away from the development housing and toward the development housing to collide the collision member with the development housing, utilizing the drive force of the drive assembly.

According to this, the drive assembly such as the development drive motor 550 to drive members disposed in the development housing such as the developer bearer such as the development roller 50 and conveying members (supply screw 53, the retrieving screw 54, etc.) to convey the developer in the development housing such as the housing 58 moves the collision member such as the beating member 41 to the direction in which the collision member is moved away from and toward the development housing. Therefore, the developing device is inexpensive in comparison with the configuration requiring another drive assembly to move the collision member to the direction in which the collision member is moved away from and toward the development housing, Aspect 2

In Aspect 1, the developing device further includes a control device such as the control unit 300 configured to reversely move the surface of the developer bearer such as the development sleeve 51 in a determined amount of the surface movement after development of the latent image on the latent image bearer such as the photoconductor 1, and wherein the collision assembly such as the beating device 40 further includes a one-way clutch configured to transmit the drive force of the drive assembly such as the development drive motor 550 to the collision member while the control device reversely moves the surface of the developer bearer.

According to this, as described in the embodiment, it is possible to reduce the size and the cost of a device in comparison with a configuration of conveying the drive force during the reverse rotation using an electromagnetic clutch.

Aspect 3

In Aspect 2, the collision device such as the beating device 40 further includes a bias member such as the compression spring 43 to bias the collision member such as the beating member 41 toward the development housing such as the housing 58 and the cam 45 including a slant surface to move the collision member away from the development housing while abutting a coupling member such as the cam follower 46 coupled to the collision member in accordance with the rotation of the cam 45 disposed rotatable around an axis in parallel with the direction of the collision member moving away and toward the development housing, and the stoppers 45*b*1 and 45*b*2 are disposed on the slant surface 45*a* of the cam 45 to stop the coupling member from climbing down the slant surface 45*a*.

According to this, as described in the embodiment, even when the moving amount of the reverse rotation is small, the coupling member such as the cam follower 46 can climb up the slant surface 45*a* in the reverse rotation multiple times, so that the collision member such as the beating member 41 can be moved away from the development housing to a degree that the toner adhering to the inner wall of the development housing can be suitably beaten off. In addition, the slant angle of the slant surface 45*a* can be gentle, thereby reducing the torque to rotate the cam 45.

Aspect 4

In Aspect 3, at the rotation angle of the cam 45 in the reverse rotation, the stoppers 45*b*1 and 45*b*2 are disposed in such a manner that the coupling member such as the cam follower 46 can climb over the stoppers 45*b*1 and 45*b*2 based on the rotation angle of the cam 45 during the reverse rotation.

Therefore, the coupling member such as the cam follower 46 climbs over the stopper per reverse rotation, thereby climbing up the slant surface.

Aspect 5

In any one of Aspects 1 to 4, the development housing such as the housing 58 includes the depressurizing opening 581 to discharge air in the development housing therethrough to restrict a rise of an air pressure in the development housing, and a filtering member such as the filter 59 is disposed on the depressurizing opening 581 to prevent the developer from being discharged out of the development housing through the depressurizing opening 581.

According to this, it is possible to prevent the inner pressure in the housing from rising and restrict spraying out of the developer through the gap between the developing roller and the development housing.

In addition, the shock impact due to the collision of the collision member such as the beating member 41 into the development housing is transmitted to the filtering member such as the filter 59, thereby beating off the developer clogging in the filtering member.

According to this, it is possible to restrict clogging in the filtering member over time. This makes it possible to suitably discharge the air in the development housing through the depressurizing opening 581 over time, thereby restricting a rise of the inner pressure in the development housing.

Aspect 6

In Aspect 5, the development housing such as the housing 58 includes multiple members, and the depressurizing opening is disposed on one of the multiple members, wherein one of the multiple members such as the development cover 58*c* further includes the facing part 582 disposed downstream of development area in the direction of the surface movement of the developer bearer during development, facing along the surface of the developer bearer with a distance therebetween.

This makes it possible to suitably beat off the developer accumulating on the facing part 582 and the developer clogging in the filtering member.

Aspect 7

In any one of Aspects 1 to 5, the development housing such as the housing 58 further includes the facing part 582 disposed downstream of development area in a direction of the surface movement of the developer bearer during development, facing along the surface of the developer bearer with a distance therebetween.

As described in the embodiment, this makes it possible to beat off the developer adhering to the facing part 582 due to the shock impact of the collision of the collision member such as the beating member 41 into the development housing. According to this, it is possible to prevent the developer from accumulating on the facing part 582.

Aspect 8

In any one of Aspects 1 to 7, the shock absorbing member such as the shock absorber 81 is disposed at the position of the development housing such as the housing 58 where the collision member such as the bearing member 41 collides the development housing.

As described in the embodiment, this makes it possible to reduce the impact noise occurring at the time of the collision of the collision member such as the beating member 41 into the development housing such as the housing 58.

Aspect 9

An image forming apparatus includes the development 5 of any one of Aspects 1 to 8 to develop a latent image formed on the latent image bearer such as the photoconductor 1 to obtain a toner image, which is finally transferred onto a recording medium such as a transfer sheet.

According to the present disclosure, the developing device can be inexpensively prepared.

This makes it possible to reduce the cost of an apparatus.

Having now fully described embodiments of the present invention, it will be apparent to one of ordinary skill in the art that many changes and modifications can be made thereto without departing from the spirit and scope of embodiments of the invention as set forth herein.

What is claimed is:

1. A developing device comprising:

a developer bearer a surface of which moves with a developer thereon;

a development housing including the developer in an inner space thereof and an opening through which the surface of the developer bearer is partially exposed in a direction of surface movement thereof to face a latent image bearer a surface of which moves with a latent image thereon;

a drive assembly disposed in the development housing, configured to drive members in the development housing driven by a driven force of the drive assembly; and a collision assembly including a collision member, the collision assembly being configured to move the collision member away from the development housing and toward the development housing to collide the collision member with the development housing, utilizing the drive force of the drive assembly.

2. The developing device according to claim 1, further comprising a control device configured to reversely move the surface of the developer bearer in an amount of the surface movement after development of the latent image on the latent image bearer, and wherein the collision assembly further includes a one-way clutch configured to transmit the drive force of the drive assembly to the collision member while the control device reversely moves the surface of the developer bearer.

3. The developing device according to claim 2, wherein the collision assembly further includes:

a coupling member coupled to the collision member;

a bias member to bias the collision member toward the development housing; and a cam disposed rotatable around an axis in parallel with the direction of the collision member moving away and toward the development housing, the cam including:

a slant surface to move the collision member away from the development housing in accordance with rotation of the cam while abutting the coupling member; and a stopper disposed on the slant surface, being configured to stop the coupling member from climbing down on the slant surface.

4. The developing device according to claim 3, wherein the coupling member climbs over the stopper based on an angle of the rotation of the cam while the control device reversely moves the surface of the developer bearer.

5. The developing device according to claim 1, wherein the development housing further includes:

a depressurizing opening to discharge air in the development housing therethrough to restrict a rise of an air pressure in the development housing, and a filter disposed on the depressurizing opening to prevent the developer from being discharged out of the development housing through the depressurizing opening.

6. The developing device according to claim 5, wherein the development housing includes a multiple members, and the depressurizing opening is disposed on one of the multiple members, wherein the one of the multiple members further includes a facing part disposed downstream of development area in a direction of the surface movement of the developer bearer during development, facing along the surface of the developer bearer with a distance therebetween.

7. The developing device according to claim 1, wherein the development housing further includes a facing part disposed downstream of development area in a direction of the surface movement of the developer bearer during development, facing along the surface of the developer bearer with a distance therebetween.

8. The developing device according to claim 1, further comprising a shock-absorbing member disposed at a point where the collision member collides in the developing device.

9. An image forming apparatus comprising:

a latent image bearer configured to bear a latent image;

the development device of claim 1 configured to develop the latent image with toner to obtain a toner image; and a transfer device configured to transfer the toner image onto a recording medium.

* * * * *